US006677563B2

(12) United States Patent
Lai

(10) Patent No.: US 6,677,563 B2
(45) Date of Patent: Jan. 13, 2004

(54) ABUSE-TOLERANT METALLIC PATTERN ARRAYS FOR MICROWAVE PACKAGING MATERIALS

(75) Inventor: Laurence M. C. Lai, Mississauga (CA)

(73) Assignee: Graphic Packaging Corporation, Golden, CO (US)

( * ) Notice: Subject to any disclaimer, the term of this patent is extended or adjusted under 35 U.S.C. 154(b) by 0 days.

(21) Appl. No.: 10/017,374

(22) Filed: Dec. 14, 2001

(65) Prior Publication Data

US 2003/0111463 A1 Jun. 19, 2003

(51) Int. Cl.[7] ..... H05B 6/80

(52) U.S. Cl. ..... 219/728; 219/729; 219/730; 426/107; 426/234

(58) Field of Search ..... 219/730, 729, 219/728, 732, 762, 725, 733, 735; 426/107, 234, 243, 109, 241, 118; 99/DIG. 14

(56) References Cited

U.S. PATENT DOCUMENTS

| | | | | |
|---|---|---|---|---|
| 2,582,174 A | | 1/1952 | Spencer | 219/10.55 E |
| 3,591,751 A | | 7/1971 | Goltsos | 219/10.55 E |
| 3,835,280 A | | 9/1974 | Gades et al. | 219/10.55 |
| 3,865,301 A | | 2/1975 | Pothier et al. | 229/14 H |
| 3,934,106 A | | 1/1976 | MacMaster et al. | 219/10.55 E |
| 3,941,967 A | | 3/1976 | Sumi et al. | 219/10.55 E |
| 3,965,323 A | * | 6/1976 | Forker, Jr. et al. | 219/730 |
| 4,190,757 A | | 2/1980 | Turpin et al. | 219/10.55 E |
| 4,230,924 A | | 10/1980 | Brastad et al. | 219/10.55 E |
| 4,267,420 A | | 5/1981 | Brastad | 219/10.55 E |
| 4,320,274 A | | 3/1982 | Dehn | 219/10.55 E |
| 4,351,997 A | | 9/1982 | Mattisson et al. | 219/10.55 E |
| 4,357,513 A | | 11/1982 | Kawata et al. | 219/10.55 B |
| 4,398,077 A | * | 8/1983 | Freedman et al. | 219/730 |
| 4,398,994 A | | 8/1983 | Beckett | 156/659.1 |
| 4,411,373 A | | 10/1983 | Kupersmit | 220/470 |

(List continued on next page.)

FOREIGN PATENT DOCUMENTS

| | | |
|---|---|---|
| CA | 2196154 | 7/1998 |
| EP | 0563999 | 10/1993 |
| WO | WO 89 04585 | 5/1989 |
| WO | WO 92 03358 | 3/1992 |
| WO | WO 97 11010 | 3/1997 |
| WO | WO 98/33724 | 8/1998 |
| WO | WO 98/35887 | 8/1998 |

*Primary Examiner*—Philip H. Leung
(74) *Attorney, Agent, or Firm*—Dorsey & Whitney LLP

(57) ABSTRACT

An abuse-tolerant microwave food packaging material includes an array of solid shapes of microwave energy reflective material, for example, of aluminum foil, disposed on a substrate. The an array of shapes of microwave energy reflective material shield microwave energy from a food product while remaining substantially resistant to arcing or burning under abusive cooking conditions in an operating microwave oven.

45 Claims, 3 Drawing Sheets

U.S. PATENT DOCUMENTS

| | | | | | |
|---|---|---|---|---|---|
| 4,552,614 | A | | 11/1985 | Beckett | 156/640 |
| 4,594,492 | A | | 6/1986 | Maroszek | 219/10.55 E |
| 4,656,325 | A | | 4/1987 | Keefer | 219/10.55 E |
| 4,703,148 | A | | 10/1987 | Mikulski et al. | 219/10.55 E |
| 4,814,568 | A | | 3/1989 | Keefer | 219/10.55 E |
| 4,851,631 | A | * | 7/1989 | Wendt | 219/729 |
| 4,866,232 | A | | 9/1989 | Stone | 219/10.55 E |
| 5,038,009 | A | | 8/1991 | Babbitt | 219/10.55 E |
| 5,117,078 | A | | 5/1992 | Beckett | 219/10.55 E |
| 5,126,518 | A | | 6/1992 | Beckett | 219/10.55 E |
| 5,260,537 | A | | 11/1993 | Beckett | 219/10.55 E |
| 5,266,386 | A | | 11/1993 | Beckett | 428/209 |
| 5,310,976 | A | | 5/1994 | Beckett | 219/728 |
| 5,310,980 | A | | 5/1994 | Beckett | 219/709 |
| 5,322,984 | A | | 6/1994 | Habager, Jr. et al. | 219/728 |
| 5,340,436 | A | | 8/1994 | Beckett | 156/639 |
| 5,354,973 | A | | 10/1994 | Beckett | 219/730 |
| RE34,829 | E | | 1/1995 | Stone | 219/730 |
| 5,391,864 | A | | 2/1995 | Bodor et al. | 219/730 |
| 5,412,187 | A | | 5/1995 | Walters et al. | 219/728 |
| 5,446,270 | A | | 8/1995 | Chamberlain et al. | 219/730 |
| 5,519,195 | A | | 5/1996 | Keefer et al. | 219/728 |
| 5,530,231 | A | | 6/1996 | Walters et al. | 219/730 |
| 5,698,127 | A | | 12/1997 | Lai et al. | 219/728 |
| 5,910,268 | A | | 6/1999 | Keefer | 219/728 |
| 5,928,555 | A | | 7/1999 | Kim et al. | 219/729 |
| 6,049,072 | A | | 4/2000 | Olson et al. | 219/727 |
| 6,054,697 | A | * | 4/2000 | Woodward et al. | 219/729 |
| 6,114,679 | A | | 9/2000 | Lai et al. | 219/728 |
| 6,133,560 | A | | 10/2000 | Zeng et al. | 219/730 |
| 6,150,646 | A | | 11/2000 | Lai et al. | 219/728 |
| 6,204,492 | B1 | | 3/2001 | Zeng et al. | 219/728 |
| 6,251,451 | B1 | | 6/2001 | Zeng | 426/107 |
| 6,501,059 | B1 | * | 12/2002 | Mast | 219/730 |
| 2001/0017297 | A1 | | 8/2001 | Zeng et al. | 219/730 |

* cited by examiner

ABUSE-TOLERANT METALLIC PATTERN ARRAYS FOR MICROWAVE PACKAGING MATERIALS

CROSS-REFERENCE TO RELATED APPLICATIONS

This application is related to U.S. Pat. No. 6,204,492 issued Mar. 20, 2001, entitled Abuse-Tolerant Metallic Packaging Materials for Microwave Cooking, and to U.S. Pat. No. 6,433,322 issued Aug. 13, 2002, also entitled Abuse-Tolerant Metallic Packaging Materials for Microwave Cooking, each of which is hereby incorporated by reference.

BACKGROUND OF THE INVENTION

1. Field of the Invention

The present invention relates to microwave-interactive packaging materials. In particular, the present invention relates to safe and abuse-tolerant microwave shielding structures in packaging materials for cooking microwavable food.

2. Description of the Related Art

Although microwave ovens have become extremely popular, they are still seen as having less than ideal cooking characteristics. For example, food cooked in a microwave oven generally does not exhibit the texture, browning, or crispness that are acquired when food is cooked in a conventional oven. In other instances, uneven cooking is exhibited wherein portions of the food may be overcooked or undercooked, soggy or dried out.

A good deal of work has been done in creating materials or utensils that permit food to be cooked in a microwave oven to obtain cooking results similar to that of conventional ovens. The most popular device used at present is susceptor material, which is an extremely thin (generally 20 to 100 Å) metallized film supported on a dimensionally stable substrate that heats under the influence of a microwave field. Various plain susceptors (typically aluminum, but many variants exist) and various patterned susceptors (for example, square matrix, flower-shaped, hexagonal, slot matrix, and "fuse" structures) are generally safe for microwave cooking. However, susceptors do not have a strong ability to modify a non-uniform microwave heating pattern in food, for example, by shielding or redistributing microwave power. The quasi-continuous electrical nature of susceptor material prevents large induced currents and thereby limits its power reflection capability, which is generally on the order of 50–55% reflection of incident microwave energy. Commonly owned U.S. Pat. No. 6,133,560 approaches the problem by creating low Q-factor resonant circuits by patterning a susceptor substrate, which provides a limited degree of power balancing. Regardless, the ability of susceptor material alone to obtain uniform cooking results in a microwave oven is limited.

Electrically "thick" or "bulk" metallic materials (e.g., foil materials) have also been used for enhancing the shielding and heating of food cooked in a microwave oven. For example, a solid foil sheet provides 100% reflection of microwave energy, thus completely shielding the food product. Foil materials are much thicker layers of metal than the thin, metallized films of susceptors. Foil materials, also often aluminum, are quite effective in the prevention of local overheating or hot spots in food cooked in a microwave by redistributing the heating effect and creating surface browning and crisping in the food cooked by the heat generated in the induced currents around the edge of the foil. However, many designs fail to meet the normal consumer safety requirements by causing fires or charring packaging, or creating arcing as a result of improper design or misuse of the material.

The reason for such safety problems is that any bulk metallic substance can carry very high induced electric currents in response to a high, applied electromagnetic field in a microwave oven cooking environment. This results in the potential for very high induced electromagnetic field strengths across any current discontinuity (e.g., across open circuit joints or between the packaging and the wall of the oven). The larger the size of the bulk metallic materials used in the package, the higher the potential induced current and induced voltage generated along the periphery of the bulk metallic substance. The applied E-field strength in a domestic microwave oven might be as high as 15 kV/m under no load or light load operation. The threat of voltage breakdown in the substrates of food packaging as well as the threat of overheating due to localized high current density may cause various safety failures. These concerns limit the commercialization of bulk foil materials in food packaging.

Commonly owned U.S. Pat. No. 6,114,679 offers a means of avoiding abuse risks with aluminum foil patterns. The structure disclosed addresses the problems associated with bulk foil materials by reducing the physical size of each metallic element in the material. Neither voltage breakdown nor current overheat will occur with this structure in most microwave ovens, even under abuse cooking conditions. Abuse cooking conditions can include any use of a material contrary to its intended purpose including cooking with cut or folded material, or cooking without the intended food load on the material. In addition, the heating effectiveness of these metallic materials is maximized through dielectric loading of the gaps between each small element that causes the foil pattern to act as a resonant loop (albeit at a lower Q-factor than the solid loop). These foil patterns were effective for surface heating. However, it was not recognized that a properly designed metallic strip pattern could also act to effectively shield microwave energy to further promote uniform cooking.

An abuse-tolerant microwave packaging material that both shields food from microwave energy to control the occurrence of localized overheating in food cooked in a microwave, and focuses microwave energy to an adjacent food surface, was disclosed in U.S. Pat. No. 6,204,492B1. To create this abuse-tolerant packaging, one or more sets of continuously repeated microwave-interactive metallic segments are disposed on a microwave-safe substrate. Each set of metallic segments defines a perimeter equal to a predetermined fraction of the effective wavelength in an operating microwave oven. Methodologies for choosing such predetermined fractional wavelengths are discussed in U.S. Pat. No. 5,910,268, which is hereby incorporated herein by reference. The metallic segments can be foil segments, or may be segments of a high optical density evaporated material deposited on the substrate. Each segment in the first set is spaced from adjacent segments so as to create a (DC) electrical discontinuity between the segments. Preferably, a set of metallic segments defines a five-lobed flower shape. The five-lobed flower shape promotes uniform distribution of microwave energy to adjacent food by distributing energy from its perimeter to its center. This abuse-tolerant packaging design on average achieves between 70–73% reflection of the incident microwave energy.

SUMMARY OF THE INVENTION

The present invention relates to an abuse-tolerant, reflective shielding pattern for use in microwave packaging materials and a method of its manufacture. The abuse-tolerant pattern is substantially opaque to incident microwave energy so as to increase reflection of microwave energy while allowing minimal microwave energy absorption. A repeated pattern or array of solid, microwave energy reflective shapes can shield microwave energy almost as effectively as a continuous bulk foil material, while resisting abuse due to cuts or tears in the packaging material or cooking without the food load. In the present invention, the abuse-tolerant array of reflective shapes achieves between 80–85% reflection of the incident microwave energy. The array of solid reflective shapes can be made of foil or high optical density evaporated materials deposited on a substrate. High optical density materials include deposited metallic films that have an optical density greater than one.

The reflective shapes prevent large induced currents from building at the edges of the material or around tears or cuts in the packaging material, thus diminishing the occurrences of arcing, charring, or fires caused by large induced currents and voltages. The reflective shapes are formed in an array, wherein each shape acts in concert with adjacent shapes to reflect a substantial percentage of the incident microwave radiation, thus shielding the food product locally and preventing overcooking. In the absence of a dielectric load (i.e., food), the microwave energy generates only a small induced current in each reflective shape and hence a very low electric field strength close to its surface, reducing the likelihood of arcing. With introduction of a dielectric food load, the current is even further reduced, enhancing the abuse tolerant properties.

Preferably, the power reflection of the abuse-tolerant reflective material is increased by combining the material in accordance with the present invention with a layer of conventional susceptor film. In this configuration, a higher surface heating environment is created through the additional excitement of the susceptor film. However, the power transmittance directly toward the food load through an abuse-tolerant reflective material according to the present invention is dramatically decreased, which leads to the shielding functionality. In the absence of food contacting the material, according to the present invention, the reflective shapes are sized such that low currents and minimal E-fields and voltage gaps are created with respect to the microwave power radiation. Thus, the chances of arcing or burning when the material is unloaded or improperly loaded are diminished.

DETAILED DESCRIPTION OF THE INVENTION

Figure 1:
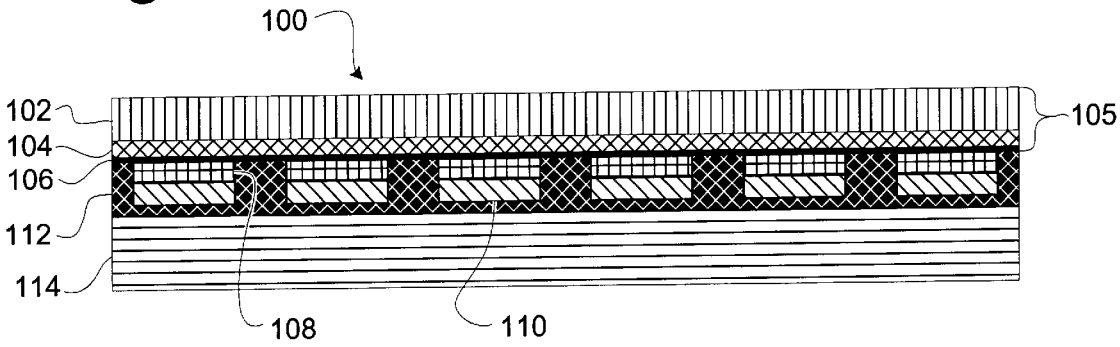
FIG. 1 is a cross-section view of a piece of abuse-tolerant microwave packaging material according to the present invention.

For a better understanding of the invention, the following detailed description refers to the accompanying drawings, wherein exemplary embodiments of the present invention are illustrated and described.

In the exemplary embodiment, the microwave packaging material is manufactured in a continuous process involving applications to and combinations of various continuous substrate webs. The continuous substrate webs may be of any width and generally depend upon the size of the manufacturing equipment and the size of the stock rolls of substrates obtained from the manufacturer. However, the process need not be continuous, and can be applied to individual substrate sheets. Likewise, each of the process steps herein described may be performed separately and at various times.

In an exemplary process, a polyester substrate, for example, 48-gauge polyester film web, is covered with a microwave interactive material, for example, aluminum, to create a structure that heats upon impingement by microwave radiation. Such a substrate layer when combined with a dimensionally stable substrate, for example, paperboard, is commonly known as a susceptor. The polyester-aluminum combination alone is referred to herein as a "susceptor film." When aluminum is used to create the microwave interactive layer of a susceptor film, it may be applied to the polyester substrate, for example, by sputter or vacuum deposition processes, to a thickness of between 20–100 Å. The completed susceptor film layer is next coated with a dry bond adhesive, preferably on the aluminum deposition layer, rather than the side with the exposed polyester for creating a laminate with at least one other substrate layer. Bonding the additional substrate to the aluminum deposition allows the polyester to act as a protective layer for the microwave interactive elements as will become apparent later in this description.

The susceptor film is next laminated to a microwave energy reflective layer, for example, a layer of metal foil that, as a solid sheet, provides 100% reflection of microwave energy. In the exemplary embodiment, aluminum foil of about 7 $\mu$m in thickness is joined to the susceptor film by the dry bond adhesive and the application of heat and/or pressure in the lamination process. Typical ranges of acceptable foil thickness for microwave packaging material may be between 6 $\mu$m and 100 $\mu$m.

In an alternative embodiment, high optical density evaporated materials deposited on a substrate may be used in place of the foil for lamination to the susceptor film. High optical density materials include deposited metallic films that have an optical density greater than one (optical density being derived from the negative logarithm of the ratio of transmitted light to incident light). High optical density materials generally have a shiny appearance, whereas thinner metallic materials, such as susceptor films, have a flat, opaque appearance.

Returning to the first exemplary embodiment, the foil layer is then covered with a patterned, etchant resistant coating. The resist coat in this exemplary process is applied in a pattern to create an abuse-tolerant pattern of the solid shapes or patches of the of the present invention the foil. Other types of foil patterns, for example, as described in U.S. Pat. Nos. 6,114,679, 6,204,492B1, and 6,251,451B1, maybe used in combination with the foil patterns of the present invention in different areas of the microwave packaging (for example, as in FIGS. 2 and 3A) to achieve desired cooking results across different portions of a food product. The susceptor film and the foil layer are exemplary types of microwave interactive materials that may be incorporated into the microwave packaging materials contemplated by the present invention. In the exemplary embodiment, the resist coat is a protective dry ink that may be printed on the foil surface by any known printing process, for example, rotogravure, web, offset, or screen-printing. The resist coat should be resistant to a caustic solution for etching the desired pattern or patterns into the foil layer.

The laminate web of susceptor film, foil, and resist coat is next immersed into and drawn through a caustic bath to etch the foil in the desired pattern. Such demetalizing procedures are described in commonly assigned U.S. Pat. Nos. 4,398,994; 4,552,614; 5,310,976; 5,266,386; and 5,340,436; the disclosures of which are incorporated herein by reference. In the exemplary embodiment, a sodium hydroxide solution of appropriate temperature is used to etch the aluminum foil exposed in the areas not covered by the printed pattern of the protective ink. The ink resist coat should also be able to withstand the temperature of the caustic bath. Patches of high optical density deposited materials can be produced by similar etching techniques or by depositing the evaporated material onto a masked surface to achieve the desired pattern. It should be noted that the dry adhesive between the foil and the susceptor film also acts as a protective resist coating, preventing the caustic solution from etching the thin aluminum deposition on the polyester substrate forming the susceptor film.

Upon emersion from the caustic bath, the laminate may be rinsed with an acidic solution to neutralize the caustic, and then rinsed again, with water, for example, to remove the residue of any solution. The laminate web is then wiped dry and/or air-dried, for example, in a hot air dryer. The resulting etched foil pattern of solid shapes provides an abuse-tolerant, highly microwave reflective layer that generates a low E-field when exposed to microwave energy when unloaded and provides an even increased level of reflective shielding when combined with a susceptor and loaded with a food product.

The laminate web is next coated with an adhesive for a final lamination step to a sturdy packaging substrate, for example, paper, paperboard, or a plastic substrate. If the chosen substrate is paper or paperboard, a wet bond adhesive is preferably used; if the substrate is a plastic, a dry bond adhesive is preferred. Typical types of paper substrates that may be used with this invention range between 10 lb and 120 lb paper. Typical ranges for paperboard substrates that may be used with the present invention include 8-point to 50-point paperboard. Similarly, plastic substrates of between 0.5 mils and 100 mils thickness are also applicable.

The adhesive is applied to the metal foil side of the susceptor film/foil laminate web. Therefore, the adhesive variously covers the resist coat covering the etched foil shapes and the exposed dry bond adhesive covering the susceptor film where the foil was etched away. The packaging substrate is then applied to the laminate web and the two are joined together by the adhesive and the application of heat and/or pressure in the lamination process.

In a typical process, the web of microwave packaging laminate is next blanked or die cut into the desired shape for use in particular packaging configurations. For example, the web may be cut into round disks for use with pizza packaging. A blanking die with a sharp cutting edge may be used to cut out the desired shape of a packaging blank from sheets of packaging material or from a web. The pre-cut microwave packaging blank may farther be placed into a forming mold with male and female sides that mate to create a three dimensional package upon the application of pressure. The use of a forming mold may be used when the microwave package is to be, for example, a tray with sidewalls, a pan, or a casserole dish. In this circumstance, the tray is generally formed by compressing a flat blank of microwave packaging material in a mold to thrust portions of the blank into sidewalls of the tray or other package form.

A cross-section of the resultant abuse-tolerant microwave packaging material 100 is shown in FIG. 1. The microwave packaging material 100 of this exemplary embodiment is formed of a polyester substrate 102 covered by a thin deposition of aluminum 104 to create a susceptor film 105. When laminated in combination with a dimensionally stable substrate (e.g., paperboard) as is the ultimate result of the microwave packaging material 100, the polyester substrate 102 and aluminum layer 104 function as a susceptor. The aluminum layer 104 is covered with a dry bond adhesive layer 106. As previously described, an aluminum foil layer 108 is adhered to the susceptor film 105 via the dry bond adhesive layer 106. Then a patterned ink resist coat 110 is printed on the foil layer 108 and the exposed foil layer 108 is etched away in a caustic bath. The resultant patterned foil layer 108 remaining after the etching process is shown in FIG. 1 covered by the patterned ink resist coat 110. The patterned foil layer 108 and ink resist coat 110 are covered by a second adhesive layer 112. For the sake of discussion, in this embodiment the adhesive layer 112 is a wet bond adhesive. The adhesive layer 112 further covers the etched areas between the patterned foil elements 108 and adheres in these areas to the dry bond adhesive layer 106. The final component of this exemplary embodiment is a dimensionally stable paperboard substrate 114 that is adhered to the previous layers by the second adhesive layer 112. Thus the various layers are laminated together to form microwave packaging material 100.

Figure 2:
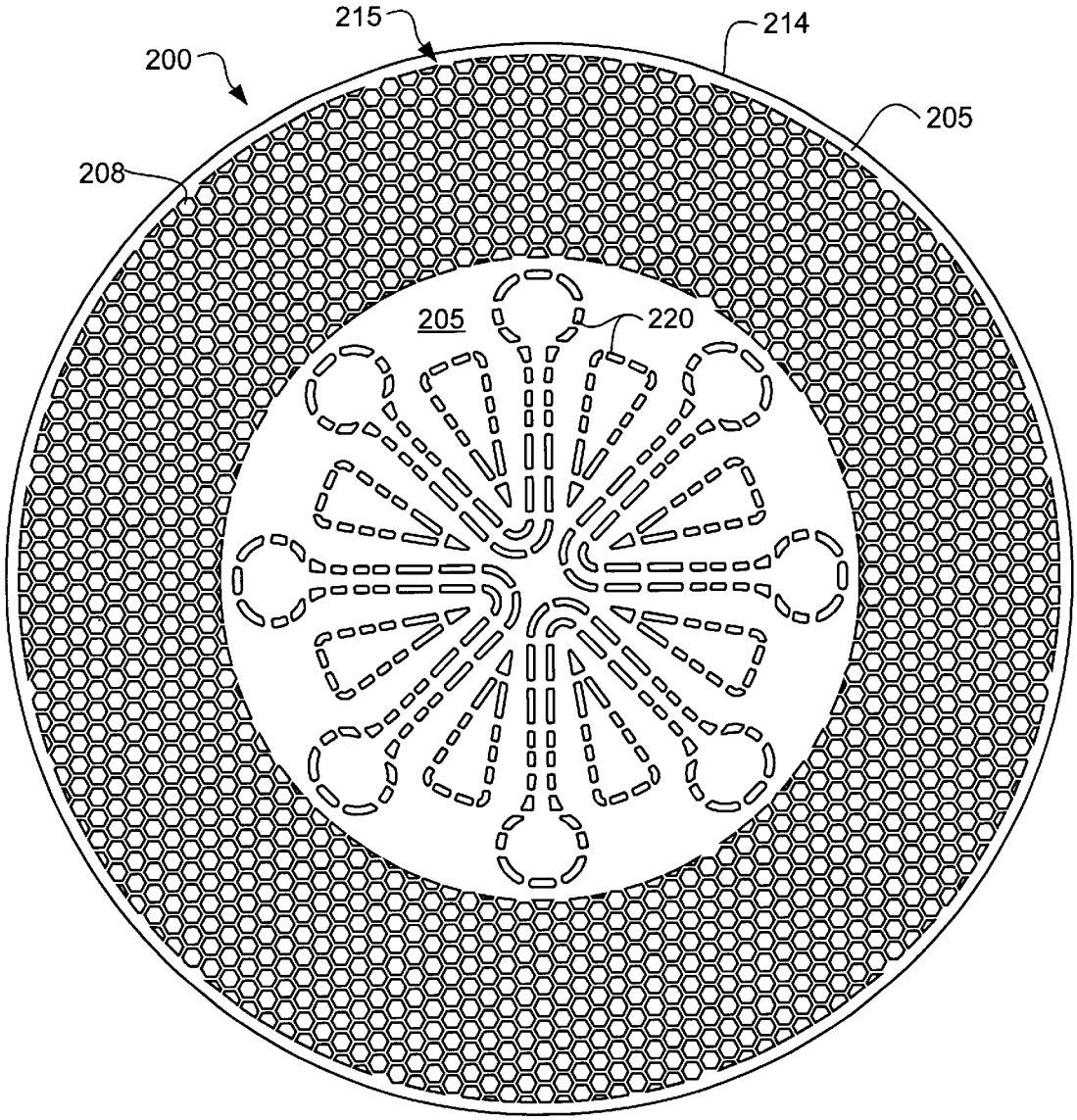
FIG. 2 is a top plan view of foil patterns in a first embodiment of the present invention on a flat blank for a pie pan before the blank is formed to create side walls.

FIG. 2 depicts an exemplary embodiment of microwave packaging material 200 according to the present invention. The microwave packaging material 200 of FIG. 2 may be manufactured by the methods previously described. The substrate 214 supports a susceptor film layer 205, which covers the surface of the substrate 214. Two separate types of abuse-tolerant etched foil patterns are included in this embodiment. The first etched-foil pattern comprises an array 215 of reflective shapes 208 according to the present invention. The second etched foil pattern comprises a power transmission pattern 220 of the types disclosed and described in detail in U.S. Pat. Nos. 6,114,679 and 6,251,451B1.

The microwave packaging material 200 as depicted in FIG. 2 is a flat blank for later formation in a compression mold into a round tray or pan with sidewalls. In its final configuration, the microwave packaging material 200 will provide high microwave energy shielding on the sidewalls, on the order of 80–85% reflection, which the array 215 of reflective shapes 208 will cover. This level of reflection is significantly higher than the reflection values in the 70% range achieved by prior art abuse-tolerant packaging. The bottom of the pan will provide more browning and crisping as a result of the more extensive exposure of the food product to the susceptor film 205 and the power transmission pattern 220 will focus microwave energy to the center of the food product.

Figure 3A:
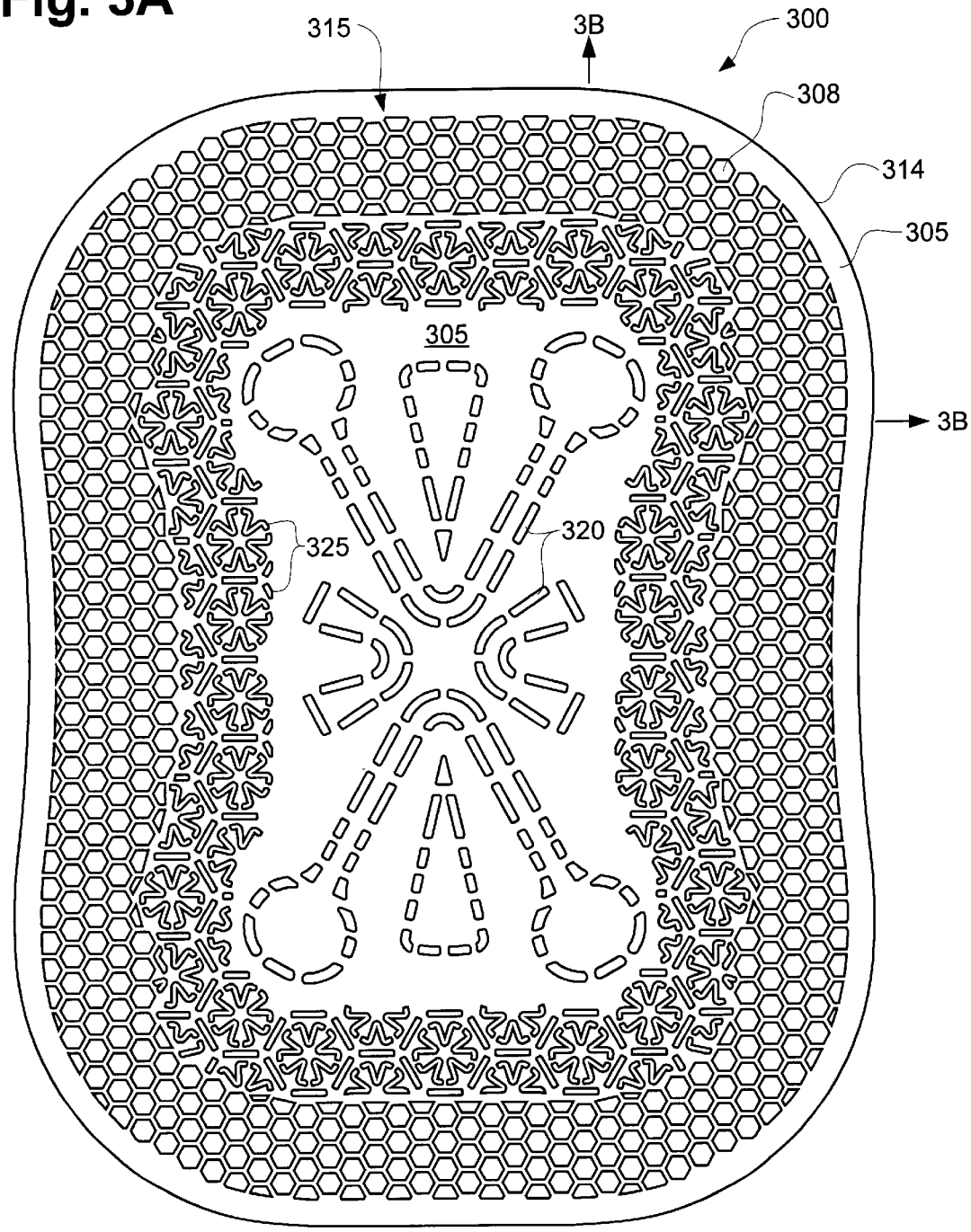
FIG. 3A is a top plan view of foil patterns in a second embodiment of the present invention on a flat blank for a casserole pan before the blank is formed to create side walls.

FIG. 3A depicts another exemplary embodiment of microwave packaging material 300 according to the present invention, the microwave packaging material 300 of FIG. 3 may also be manufactured by the methods previously described. The substrate 314 supports a susceptor film layer 305, which covers the surface of the substrate 314. Three separate types of abuse-tolerant etched foil patterns are included in this embodiment. The first etched-foil pattern comprises an array 315 of reflective shapes 308 according to the present invention. The second etched foil pattern comprises a power transmission pattern 320 of the types disclosed and described in detail in U.S. Pat. Nos. 6,114,679 and 6,251,451B1. The third etched foil pattern comprises a segmented abuse-tolerant pattern 325 as disclosed and described in U.S. Pat. No. 6,204,492B1.

The microwave packaging material 300 as depicted in FIG. 3A is a flat blank for later formation in a compression mold into a generally rectangular casserole pan with sidewalls. In its final configuration, the microwave packaging material 300 will provide high microwave energy shielding on the upper sidewalls which the array 315 of reflective shapes 308 will cover. The transition area between the lower sidewalls and the bottom of the casserole pan will provide lesser reflective shielding and greater browning and crisping in accord with the functionality of the segmented abuse-tolerant pattern 325. The bottom of the pan will provide more browning and crisping as a result of the more extensive exposure of the susceptor film 305 and the power transmission pattern 320 will focus microwave energy to the center of the food product.

The reflective shapes 208, 308 depicted in the exemplary embodiments of FIG. 2 and FIG. 3A are solid, tiled, hexagon patches. The hexagon is an excellent basic polygon to select due to its ability to nest perfectly along with its high degree of cylindrical symmetry. Other shapes for use as reflective shapes 208, 308, for example, circles, ovals, and other curvilinear shapes, preferably symmetrical curvilinear shapes, triangles, squares, rectangles, and other polygonal shapes, preferably right polygons, and even more preferably equilateral polygonal shapes, are within the scope of the present invention. These reflective shapes are preferably configured in arrays such that they are similarly capable of tiling or nesting. In addition, the arrays 215, 315 of reflective shapes 208, 308 need not be repetitive of a single shape, but instead can be combinations of various shapes, preferably capable of nesting or tiling together with small gaps between the reflective shapes 208, 308. For example, an array of shapes might be an array of nested hexagons and polygons, as in the patchwork of a soccer ball.

As used herein the term "symmetrical curvilinear shape" means a closed curvilinear shape that can be divided in half such that the two halves are symmetrical about an axis dividing them. As used herein, the term "right polygon" means a polygon that can be divided in half such that the two halves are symmetrical about an axis dividing them. Equilateral polygons would therefore be a subset of right polygons.

Figure 3B:
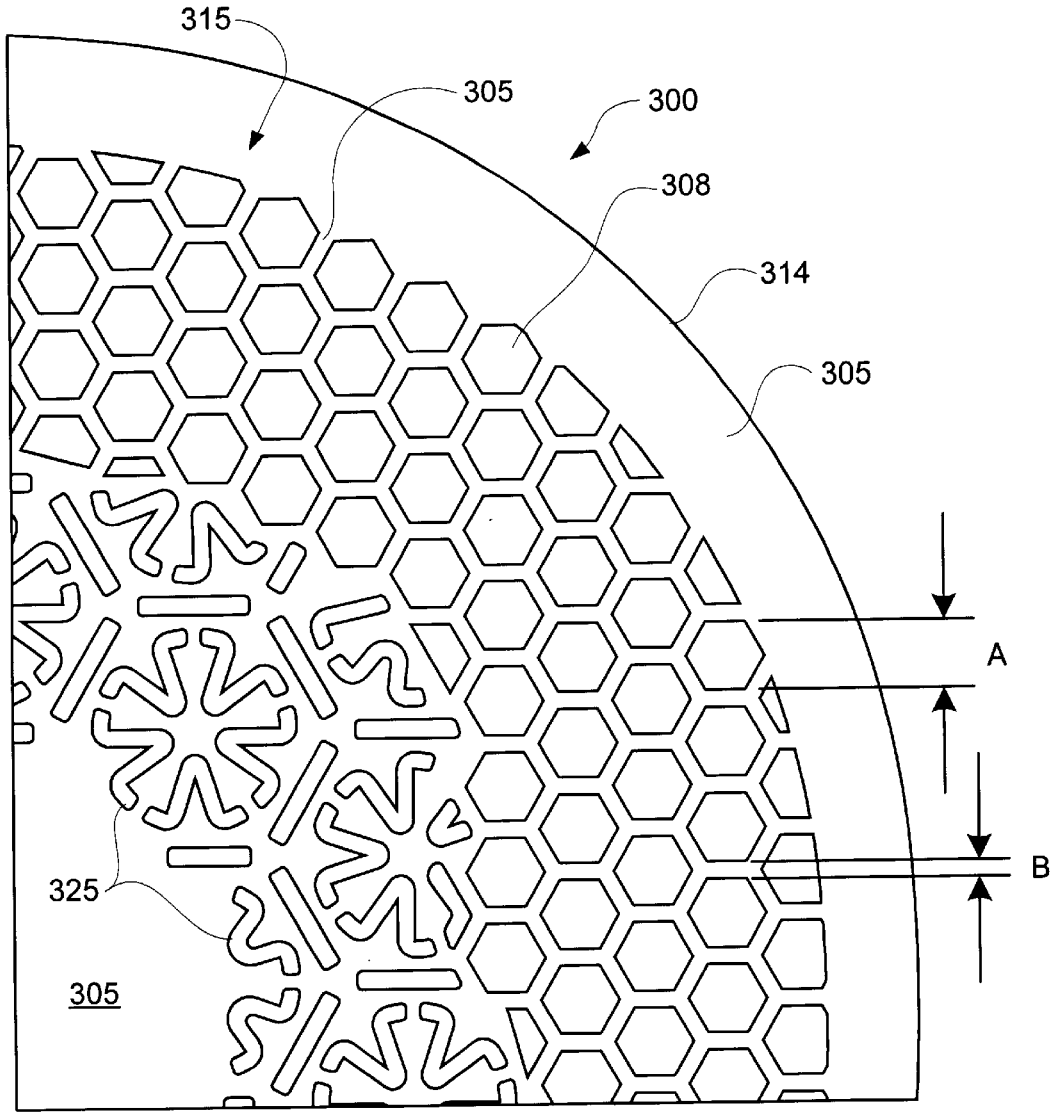
FIG. 3B is an enlarged view of a portion of the flat blank for the casserole pan of FIG. 3A.

In addition to varying the shapes of the reflective shapes 208, 308, the width A and/or length of the perimeter of the reflective shapes 308, as shown in detail in FIG. 3B, is another feature that determines the effective microwave energy shielding strength and the degree of abuse-tolerance of the array 315. If the width A is too small, the reflective shapes 308 become highly transparent as the microwave are not impeded by any substantial surface area. If the width A is too large, the reflective shapes 308 become less abuse-tolerant as the energy distribution between the reflective shapes 308 becomes highly uneven and too high in some.

A third feature that influences the effective microwave energy shielding strength and the degree of abuse-tolerance of the array 315 is the separation distance B between the reflective shapes 308 in the abuse-tolerant reflective array 315, as shown in detail in FIG. 3B. As the spacing between each reflective shape 308 increases, the shielding ability becomes less effective. On the other hand, as the spacing between each reflective shape 308 decreases, the shielding becomes more effective, but the chance of arcing between reflective shapes increases.

Each of the features controlling the reflective ability of the abuse-tolerant reflective array 315—shape, width, and spacing—may be varied individually or in combination to achieve an appropriate level of shielding desired for any particular food product, while maintaining safe tolerance levels for abusive cooking situations. For example, in one preferred embodiment, each reflective shape 308 is an equilateral hexagon, the width A of each hexagon is about 4 mm, and the gap B between each metallic patch is about 1 mm.

The abuse-tolerant patterned foil layer 108 redistributes incident microwave energy by increasing the reflection of microwave energy while still allowing some microwave energy absorption by the susceptor film 105. A repeated pattern or array 215 of microwave reflective shapes 208, e.g., of metallic foil, as shown in FIG. 2, can shield the majority of incident microwave energy almost as effectively as a continuous bulk foil material. The array 215 does absorb some microwave energy and through the gaps between the reflective shapes 208 some energy reaches the adjacent susceptor film 205 resulting in some local heating, albeit not to the intensity of heat a susceptor might otherwise attain.

The array 215 of reflective shapes 208 is substantially resistant to abusive cooking conditions. Abusive cooking conditions include, for example, operating a microwave oven containing the packaging material 200 when the microwave packaging material 200 has only a partial or no food load, or when the packaging material 200 is torn or cut. By using the inventive array 215 of reflective shapes 208, large induced currents are prevented from building at the edges of the packaging material 200 or around tears or cuts in the packaging material 200, thus diminishing the occurrences of arcing, charring, or burning caused by large induced currents and voltages.

The power reflection of the abuse-tolerant reflective array 215 is increased through the combination of the patterned foil layer 108 with the susceptor film layer 105 (as shown in FIG. 1). When, for example, food, a glass tray, or a layer of plain susceptor film contacts the abuse-tolerant array 215 of reflective shapes 208, the capacitance between adjacent reflective shapes 208 is raised as each of these substances has a dielectric constant much larger than a typical substrate 214 on which the small reflective shapes 208 are located. Of these substances, food has the highest dielectric constant (often by an order of magnitude). This creates a continuity effect of connected reflective shapes 208, which then work as a low Q-factor power reflection sheet with the same function of many designs that would otherwise be unable to withstand abuse conditions. Each reflective shape 208 also acts as a small heating element when under the influence of microwave energy, to the extent that the reflective shapes 208 absorb rather than transmit the microwave energy not reflected.

In this configuration, a surface-heating environment is further created through the additional excitement of the susceptor film 205 and the contact between the food product and the susceptor film 205 exposed between the small reflective shapes 208. However, such surface heating is not substantial. In practice, if a susceptor film 205 is desired in the overall packaging design to provide significant surface heating on a portion of the packaging material 200, it is economical in the manufacturing process to simply incorporate the susceptor film across the entire web of packaging material and cover it with the reflective array 215 in locations were energy reflection is desired. In such a configuration, the susceptor film increases the reflectivity of the array 215 and the heating due to the susceptor film 205 in the same area is insubstantial.

If a susceptor film 205 is used in conjunction with the array 215, the spacing between adjacent reflective shapes 208 in the array 215, for a particular size of reflective shape 208, may need to be increased from the optimal spacing when the array 215 is used without susceptor film 205. (In the alternative, the size of the reflective shapes 208 may be reduced to reach the same result.) While the susceptor film 205 helps increase the reflectivity of the array 215 and provides some minor surface heating, and even though the susceptor film 205 acts as a dielectric to some extent, the microwave energy interactive properties of the susceptor film 205 can also enhance the E-field created at the edge of the reflective shapes 208. Further in high heating conditions, susceptor film 205 has been known to break down to create a semi-conducting material. These conditions induced by the susceptor film 205 may result in a slight increase in the propensity for arcing between adjacent reflective shapes 208. Therefore, the spacing between adjacent reflective shapes 208 should be adjusted accordingly, between a 30 and 50 percent increase in the separation distance B between the reflective shapes 208, when the array 215 is used in conjunction with susceptor film 205. When, these minor adjustments are made, the abuse-tolerant microwave packaging material 200 according to the present invention, including a layer of susceptor film 205, has resisted arcing and burning upon exposure to microwave energy in a microwave oven for over a minute of cooking time.

Because of the high power reflection properties, the power transmittance directly toward the food load through the abuse-tolerant reflective array 215 layer is dramatically decreased, which leads to shielding of the food product from microwave energy. At the same time, the microwave energy generates only a small induced current in each reflective shape 208 comprising the array 215, and hence a very low electric field strength close to the surface of the microwave packaging material 200 and a low voltage gap between adjacent reflective shapes 308 with respect to the microwave radiation power. Thus, the chances of arcing or burning when the microwave packaging material 200 is unloaded or improperly loaded are diminished.

While the invention is described herein with respect to exemplary embodiments of microwave packaging material of perhaps a disposable variety, it should be recognized that the teachings of the present invention may be used in conjunction with reusable cookware, for example, glass or ceramic containers. The arrays of microwave energy reflective shapes disclosed herein may be applied to chosen surfaces of the reusable cookware, for example by adhesion and etching or patterned vapor deposition. Further, in the case of glass cookware, a film with an array of microwave energy reflective shapes may be sandwiched between layers of glass during the manufacture of the cookware. In these embodiments, the arrays of microwave energy reflective shapes may provide similar shielding properties for foods cooked in the reusable cookware.

Although various embodiments of this invention have been described above with a certain degree of particularity, or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. An abuse-tolerant microwave packaging material comprising:

a substrate; and a plurality of uniform solid shapes comprised of microwave energy reflective material arranged in an array, wherein said array is supported by said substrate;

wherein each of said plurality of solid shapes further comprises:

a respective predetermined shape; and a respective predetermined size; and wherein each of said plurality of solid shapes in said array is spaced apart from each adjacent shape by a respective predetermined spacing; and wherein a combination of said predetermined shape, said predetermined size, and said predetermined spacing provides substantial resistance to arcing or burning of said packaging material under abusive looking conditions in an operating microwave oven.

2. The abuse-tolerant microwave packaging material as described in claim 1, further comprising a microwave interactive material layer supported by said substrate.

3. The abuse-tolerant microwave packaging material as described in claim 2, wherein said microwave interactive material layer comprises a susceptor film.

4. The abuse-tolerant microwave packaging material as described in claim 3, wherein said susceptor film comprises a deposition of aluminum on a microwave transparent substrate.

5. The abuse-tolerant microwave packaging material as described in claim 1, wherein said microwave energy reflective material comprises a metal foil.

6. The abuse-tolerant microwave packaging material as described in claim 5, wherein said metal foil comprises aluminum foil.

7. The abuse-tolerant microwave packaging material as described in claim 1, wherein said microwave energy reflective material comprises a high optical density evaporated material deposited on a microwave transparent substrate.

8. The abuse-tolerant microwave packaging material as described in claim 7, wherein said high optical density evaporated material comprises aluminum.

9. The abuse-tolerant microwave packaging material as described in claim 1, wherein said predetermined shape comprises a shape selected from the group of shapes comprising: a circle, an oval, a curvilinear shape, a symmetrical curvilinear shape, a triangle, a square, a rectangle, a polygon, a right polygon, and an equilateral polygon.

10. The abuse-tolerant microwave packaging material as described in claim 9, wherein said equilateral polygon is a hexagon.

11. The abuse-tolerant microwave packaging material as described in claim 1, wherein each of said plurality of solid shapes in said array is nested with each said adjacent shape in said array in a tile-like pattern.

12. The abuse-tolerant microwave packaging material as described in claim 11, wherein said predetermined spacing is a distance of about 1 mm.

13. The abuse-tolerant microwave packaging material as described in claim 1, wherein said predetermined spacing comprises an equal distance apart from and with respect to each said adjacent shape in said array.

14. The abuse-tolerant microwave packaging material as described in claim 1, wherein said predetermined size is about 4 mm in width.

15. The abuse-tolerant microwave packaging material as described in claim 1, wherein said substrate is microwave transparent.

16. The abuse-tolerant microwave packaging material as described in claim 1, wherein said substrate is selected from a group of substrates comprising: paper, paperboard, plastic, glass, and ceramic.

17. The abuse-tolerant microwave packaging material as described in claim 3, wherein said packaging material reflects between 80 and 85 percent of microwave energy incident upon said microwave packaging material when said microwave packaging material is placed in said operating microwave oven.

18. A method of manufacturing a microwave packaging material comprising:

providing a substrate; and adhering a microwave energy reflective layer to said substrate;

wherein said microwave energy reflective layer comprises a plurality of uniform solid shapes comprised of microwave energy reflective material arranged in an array; and wherein each of said plurality of shapes further comprises:

a respective predetermined shape; and a respective predetermined size; and wherein each of said plurality of solid shapes in said array is spaced apart from each adjacent shape by a respective predetermined spacing; and wherein a combination of said predetermined shape, said predetermined size, and said predetermined spacing provides substantial resistance to arcing by or burning of said microwave packaging material under abusive cooking conditions in an operating microwave oven.

19. The method as described in claim 18, further comprising cutting said microwave packaging material into a packaging shape.

20. The method as described in claim 19, further comprising compression molding said microwave packaging material to create a pan or tray with sidewalls.

21. The method as described in claim 18, further comprising adhering a microwave interactive material layer to said microwave energy reflective layer.

22. The method as described in claim 21, wherein said microwave interactive material layer comprises a susceptor film.

23. The method as described in claim 22, wherein said susceptor film comprises a deposition of aluminum on a microwave transparent substrate.

24. The method as described in claim 18, wherein said microwave energy reflective material comprises a metal foil.

25. The method as described in claim 24, wherein said metal foil comprises aluminum foil.

26. The method as described in claim 18, wherein said microwave energy reflective material comprises a high optical density evaporated material deposited on a microwave transparent substrate.

27. The method as described in claim 26, wherein said high optical density evaporated material comprises aluminum.

28. The method as described in claim 18, wherein said predetermined shape comprises a shape selected from the group of shapes comprising: a circle, an oval, a curvilinear shape, a symmetrical curvilinear shape, a triangle, a square, a rectangle, a polygon, a right polygon, and an equilateral polygon.

29. The method as described in claim 28, wherein said equilateral polygon is a hexagon.

30. The method as described in claim 18, wherein each of said plurality of solid shapes in said array is nested with each said adjacent shape in said array in a tile-like pattern.

31. The method as described in claim 18, wherein said predetermined spacing comprises an equal distance apart from and with respect to each said adjacent shape in said array.

32. The method as described in claim 31, wherein said predetermined spacing is a distance of about 1 mm.

33. The method as described in claim 18, wherein said predetermined size is about 4 mm in width.

34. The method as described in claim 18, wherein said substrate is microwave transparent.

35. The method as described in claim 18, wherein said substrate is selected from a group of substrates comprising: paper, paperboard, plastic, glass, and ceramic.

36. The method as described in claim 22, wherein said microwave packaging material reflects between 80 and 85 percent of microwave energy incident upon said packaging material when said packaging material is placed in said operating microwave oven.

37. An abuse-tolerant microwave shielding material comprising:

a substrate;

an array of uniform solid shapes of microwave reflective material supported upon said substrate;

wherein each of said solid shapes further comprises:

a respective predetermined shape; and a respective predetermined size; and wherein each of said solid shapes in said array is spaced apart from each adjacent solid shape by an equal distance with respect to each adjacent solid shape; and a susceptor film supported upon said substrate;

wherein said abuse-tolerant microwave shielding material reflects between 80 and 85 percent of microwave energy incident upon said shielding material when said shielding material is placed in an operating microwave oven; and wherein a combination of said predetermined shape, said predetermined size, and said spacing provides substantial resistance to arcing by or burning of said abuse-tolerant microwave shielding material under abusive cooking conditions in said operating microwave oven.

38. The abuse-tolerant microwave shielding material of claim 37, wherein said predetermined shape comprises a shape selected from the group of shapes comprising: a circle, an oval, a curvilinear shape, a symmetrical curvilinear shape, a triangle, a square, a rectangle, a polygon, a right polygon, and an equilateral polygon.

39. The abuse-tolerant microwave shielding material as described in claim 38, wherein said equilateral polygon is a hexagon.

40. The abuse-tolerant microwave shielding material as described in claim 37, wherein said substrate is selected from the group comprising: paper, paperboard, plastic, glass, and ceramic.

41. An improvement to reusable, microwave-safe cookware, the improvement comprising:

an abuse-tolerant microwave shielding material further comprising a substrate;

an array of uniform solid shapes of microwave reflective material supported upon said substrate;

wherein each of said solid shapes further comprises:

a respective predetermined shape; and a respective predetermined size; and wherein each of said solid shapes in said array is spaced apart from each adjacent solid shape by an equal distance with respect to each adjacent solid shape; and a susceptor film supported upon said substrate;

wherein said abuse-tolerant microwave shielding material is applied to said reusable cookware;

wherein said abuse-tolerant microwave shielding material reflects between 80 and 85 percent of microwave energy incident upon said shielding material when said microwave-safe cookware is placed in an operating microwave oven; and wherein a combination of said predetermined shape, said predetermined size, and said spacing provides substantial resistance to arcing by or burning of said abuse-tolerant microwave shielding material under abusive cooking conditions in said operating microwave oven.

42. The improvement as described in claim 41, further comprising a microwave interactive material layer supported by said substrate.

43. The improvement as described in claim 41, wherein said reusable cookware comprises ceramic cookware.

44. The improvement as described in claim 41, wherein the reusable cookware comprises glass cookware.

45. The improvement as described in claim 44, wherein:

said glass cookware is further comprised of:

a first layer of glass; and a second layer of glass; and wherein said abuse-tolerant microwave shielding material is sandwiched between said first layer of glass and said second layer of glass.

* * * * *